US005317360A

United States Patent [19]

Woog

[11] Patent Number: 5,317,360

[45] Date of Patent: May 31, 1994

[54] CHEMICAL RECYCLER FOR PHOTO PROCESSING MACHINE

[76] Inventor: Gunter Woog, 5435 Bauers Dr., West Bend, Wis. 53095

[21] Appl. No.: 879,939

[22] Filed: May 8, 1992

Related U.S. Application Data

[63] Continuation-in-part of Ser. No. 775,917, Oct. 15, 1991, and a continuation-in-part of Ser. No. 617,522, Nov. 23, 1990, Pat. No. 5,057,858.

[51] Int. Cl.[5] ..... G03D 3/02

[52] U.S. Cl. ..... 354/324

[58] Field of Search ..... 354/324, 319-322; 137/563, 565

[56] References Cited

U.S. PATENT DOCUMENTS

| | | | |
|---|---|---|---|
| 3,557,752 | 1/1971 | Hakanson | 354/324 X |
| 3,990,088 | 11/1976 | Takita | 354/324 |
| 4,349,267 | 9/1982 | Ohtani | 354/324 X |
| 4,506,986 | 3/1985 | Freeman | 137/563 |
| 4,577,950 | 3/1986 | Mackson | 354/324 |
| 4,650,339 | 3/1987 | Chetcuti et al. | 137/563 |
| 4,728,408 | 3/1988 | Palazzolo | 204/229 |
| 4,804,452 | 2/1989 | Rhodes | 137/565 |
| 4,999,660 | 3/1991 | Wright | 354/324 |

*Primary Examiner*—D. Rutledge

*Attorney, Agent, or Firm*—Ryan, Kees & Hohenfeldt

[57] ABSTRACT

A device for recycling developer and fixer into a photo processing machine. The device includes a first container for receiving and containing a chemical liquid flowing from the overflow outlet of one of the chemical tanks of the photo processing machine and a second container for receiving and containing a mixture of used chemical liquid from the first container and fresh unused chemical from a source thereof. A pump is provided for pumping a fixed ratio of the liquid from the first container and the fresh unused chemical into the inlet of the second container. An outlet in said second container is connected to the one of said replenishment pumps connected to the appropriate tank of the photo processing machine. The pump for pumping the fixed ratio of liquids is preferably a dual head bellows type metering pump. A preferred pumping ratio provides for delivery of 45% recycled chemical and 55% new chemical with each pump stroke. A high limit float switch to deactivate the pump inputting liquids and a low limit float switch to activate pumping of liquids therein when the liquid in said container falls below a selected level are preferably provided.

8 Claims, 1 Drawing Sheet

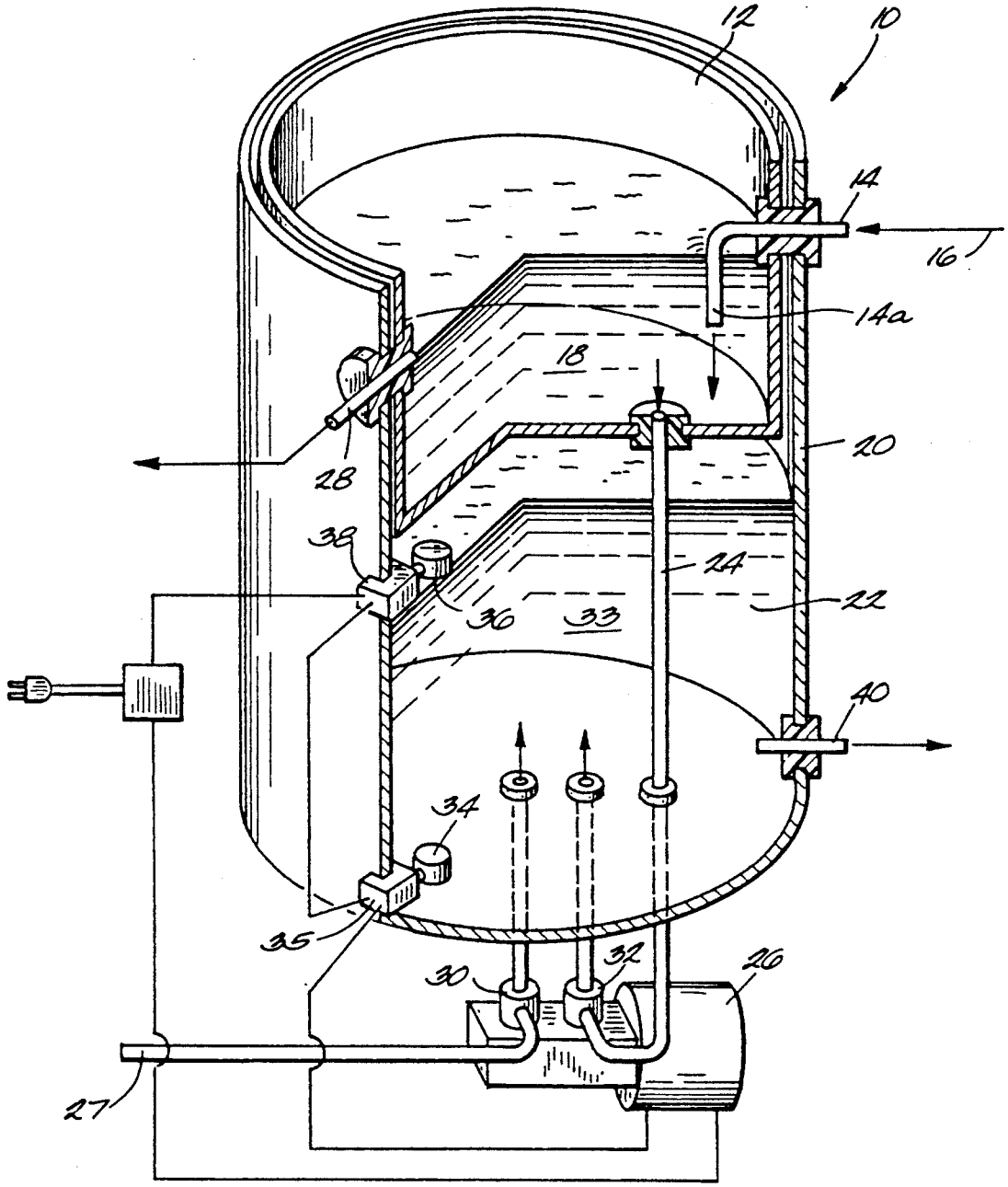
12
10
14
16
14a
18
20
28
38
24
36
33
22
40
34
35
30
32
26
27

CHEMICAL RECYCLER FOR PHOTO PROCESSING MACHINE

This is a continuation-in-part of copending application(s) 07/617,522, filed Nov. 23, 1990 Ser. No. 07/775,917 filed on Oct. 15, 1991.

BACKGROUND OF THE INVENTION

This invention relates to photo processing machines, and in particular to apparatus for automating the recycling of developer and fixer chemicals in such machines.

In my co-pending applications Ser. No. 07/775,917 filed Oct. 15, 1991 and Ser. No. 07/617,522 filed Nov. 23, 1990, now U.S. Pat. No. 5,057,858, I described systems for recycling photographic developers and fixers. The present invention relates to further ways to provide for recycling of such photographic chemicals in photo finishing equipment.

One problem the occurs in recycling of photographic chemicals is the buildup of salts that can act to inhibit the photographic fixing process. Such a buildup can be avoided by redilution of the used fixer with new fixer while continually removing a portion of the used chemicals.

SUMMARY OF THE INVENTION

This invention relates to improvements to methods and apparatus for recycling of photographic chemicals that is especially applicable to small photographic developing machines. It is a principal object of the invention to provide improved apparatus for that purpose.

In furtherance of this object a device for recycling developer fixer into a photo processing machine is provided which includes containers for containing chemicals coming out of overflow outlets of the photo processing machine. The chemicals flow into the container, and a portion thereof are recycled and returned together with fresh chemicals to the processing machine. A portion of the used chemicals are discharged to a drain.

Briefly summarized, this invention provides a device for recycling developer and fixer into a photo processing machine which includes a first container for receiving and containing a chemical liquid flowing from the overflow outlet of one of the chemical tanks of the photo processing machine and a second container for receiving and containing a mixture of used chemical liquid from the first container and fresh unused chemical from a source thereof. A pump is provided for pumping a fixed ratio of the liquid from the first container and the fresh unused chemical into the inlet of the second container. An outlet in said second container is connected to the one of said replenishment pumps connected to the appropriate tank of the photo processing machine. The pump for pumping the fixed ratio of liquids is preferably a dual head bellows type metering pump. A preferred pumping ratio provides for delivery of 45% recycled chemical and 55% new chemical with each pump stroke.

A high limit float switch to deactivate the pump inputting liquids and a low limit float switch to activate pumping of liquids therein when the liquid in said container falls below a selected level are preferably provided.

In accordance with a further aspect of the invention, an automixer is not used, but rather, a metering replenishment pump controls the flow of blended chemicals from the second container into the inflow inlet of the photo processing machine.

Generally, a photo processing machine has at least overflow outlets and bulk chemical storage tanks for developer and fixer liquids. An automixer of the specific gravity controlled type may also be employed for inputting the blended chemicals. Such an automixer contains tanks for mixing photographic chemicals and inputting them into the photo processing machine and automatically redilutes the system with additional water, when needed, to maintain the prescribed specific gravity.

A filter on the order of 5 to 10 microns may be positioned in the fluid flow lines of the recycling system for filtering out solids in the recycled chemicals.

Other objects and advantages of the invention will become apparent hereinafter.

DESCRIPTION OF THE DRAWINGS

FIG. 1 is a side cross-sectional view, partially schematic, of an apparatus constructed according to an embodiment of the invention.

DESCRIPTION OF THE PREFERRED EMBODIMENT

Referring now to the FIG. 1, it can be seen that the recycling apparatus 10 shown there, constructed according to a preferred embodiment of the invention, includes a first container 12. Container may be provided with a cover, if desired.

In a conventional photo processing system, a photo processing machine (not shown) includes separate tanks for developer and fixer. Each tank is provided with an overflow outlet, which is normally connected to a drain or possibly some silver reclamation device which is in turn connected to the drain. In such a conventional system, the fresh photo developer and fixer chemicals and water are introduced into their respective tanks by means of a regeneration pump or an automixer which mixes the chemicals before passing them into the photo processing machine.

The conventional system, however, results in substantial waste of fixer and developer. Hence the present invention is provided to avoid this waste. To that end, in the embodiment of FIG. 1, a container inlet 14 is provided to deliver a stream 16 of chemical flowing out of the overflow outlet of the photo processing machine into the container 12. This container inlet 14 is connected to the overflow outlet of the processing machine by means of appropriate tubes or conduits. Because it can be detrimental to certain of the chemicals, the container inlet 14 is constructed to minimize agitation of the liquid upon introduction into the container. Hence the outlet **14*a* of the container inlet 14 is positioned beneath the surface of the liquid 18** in the container.

The invention also calls for an overflow outlet 28, which is connected to a drain. In order to give control of the liquid level several overflow outlets at different levels can be provided. As liquid flows out of the photo processor, container 12 fills, up to the level of the container overflow 28, after which time the liquid 18 overflows to the drain or other disposal means. It is desirable to utilize a silver reclamation device of a commercially available type such as a Silver Trap Window Series® metallic replacement silver recovery device marketed by USI, Inc. of West Bend, Wis.

An outflow conduit 24 is provided for removing liquid 18 from container 12 for recycling. Conduit 24 is connected to pump 26 which is preferably of the dual head bellows type. Connected to the other head of pump 26 is an inflow line 27 connected to a source of fresh photographic chemical, either developer or fixer as the case may be. Conduits 30 and 32 are provided leading from dual head pump 26 to a second container 22 used for supplying the blended new and recycled chemical liquids for introduction into the photo finishing machine. Second container 22 is preferably provided with a float 34 that operates a low level limit switch 35 which causes activation of pump 26 if the level of liquid 33 in container 22 falls to a low level. A similar float 36 also operates a high level limit switch 38. Switch 38 is also wired to pump 26 so that pump 26 will be deactivated when liquid level 33 causes float 36 to rise in container 22. It is preferred that pump 26 be configured to deliver 55% fresh chemical liquid, either developer or fixer, and to container 22 and 45% of recycled liquid 18 into said container. However, other ratios of said liquids can be utilized if desired.

Near the bottom of container 22 there is provided an outflow opening 40 to which is connected an outflow line leading to the regeneration pump of the photoprocessing machine. A combined mixed flow of used and recycled chemical liquid is thus provided to the photoprocessing machine. It will be understood that while one recycling device 10 has been shown for purposes of illustrations that separate devices of the same type are provided for the developer and fixer liquids. It will also be noted that while containers 12 and 22 are illustrated as being positioned one within the other, the containers can readily be separated and positioned side-by-side or one above the other as desired.

While the apparatus hereinbefore described is effectively adapted to fulfill the aforesaid objects, it is to be understood that the invention is not intended to be limited to the specific preferred embodiment of fixer recycler in connection with photo processing machine set forth above. Rather, it is to be taken as including all reasonable equivalents within the scope of the following claims.

I claim:

1. A device for recycling a liquid chemical selected from the group consisting of fixer solution and developer solution into a photo processing machine, said photo processing machine having a fixer tank with and inlet and an overflow outlet and a developer tank with an inlet and an overflow outlet, and a metering replenishment pump for inputting chemicals into each of said tanks, said device comprising:

at least one first container for receiving and containing a chemical liquid flowing from the overflow outlet of one of said tanks;

an inlet into said first container, connected to the overflow outlet, for permitting liquid to flow from the overflow outlet into said first container;

a source of fresh chemical liquid, at least one second container for receiving and containing a mixture of used chemical liquid from said first container and fresh unused chemical from said source thereof, a pump for pumping a fixed ratio of the liquid from said first container and said fresh unused chemical into the inlet of said second container, an outlet in said second container connected to the one of said replenishment pumps connected to said one of said tanks.

2. A device according to claim 1 wherein said pump for pumping said fixed ratio of liquids is a dual head bellows type metering pump.

3. A device according to claim 2 wherein said pump delivers 45% recycled chemical and 55% new chemical with each pump stroke.

4. A device according to claim 3 wherein

5. A device for recycling a liquid chemical photographic developer solution into a photo processing machine, said photo processing machine having a developer tank with an inlet and an overflow outlet, and a metering replenishment pump for inputting chemicals into said tank, said device comprising:

a first container for receiving and containing liquid flowing from the overflow outlet of said developer tank;

an inlet into said first container, connected to the overflow outlet, for permitting liquid to flow from the overflow outlet into said first container;

a source of fresh chemical developer liquid, a second container for receiving and containing a mixture of used developer liquid from said first container and fresh unused developer from said source thereof, a pump for pumping a fixed ratio of the liquid from said first container and said fresh unused developer into the inlet of said second container, an outlet in said second container connected to said replenishment pump.

6. A device according to claim 1 wherein said second container comprises a high limit float switch to deactivate the pump inputting liquids therein.

7. A device according to claim 6 wherein said second container is provided with a low limit float switch to activate pumping of liquids therein when the liquid in said container falls below a selected level.

8. A device according to claim 1 wherein said first container has at least one overflow outlet therein, positioned so as to permit the outflow of chemical from said container when the level of the chemical reaches a predetermined level in the container.

* * * * *